US006652171B1

(12) United States Patent
Onishi

(10) Patent No.: US 6,652,171 B1
(45) Date of Patent: Nov. 25, 2003

(54) PRINTING MEDIUM, MANUFACTURING METHOD OF THE SAME, AND PRINTING METHOD

(76) Inventor: Hiroyuki Onishi, c/o Seiko Epson Corporation, 3-5, Owa 3-chome, Suwa-shi, Nagano (JP)

( * ) Notice: Subject to any disclaimer, the term of this patent is extended or adjusted under 35 U.S.C. 154(b) by 0 days.

(21) Appl. No.: 09/644,570

(22) Filed: Aug. 24, 2000

(65) Prior Publication Data

(65)

Related U.S. Application Data

(63) Continuation of application No. 08/946,222, filed on Oct. 7, 1997, now Pat. No. 6,173,649.

(30) Foreign Application Priority Data

| | | |
|---|---|---|
| Oct. 7, 1996 | (JP) | 8-265847 |
| Dec. 27, 1996 | (JP) | 8-350313 |
| Feb. 18, 1997 | (JP) | 9-33941 |
| Feb. 21, 1997 | (JP) | 9-37827 |

(51) Int. Cl.[7] ..... B41J 11/26; B42D 15/00

(52) U.S. Cl. ..... 400/621; 101/485; 101/93.07; 283/100; 283/105; 156/252; 493/355; 493/404; 83/861; 83/880; 83/881

(58) Field of Search ..... 101/481, 483, 101/488, 486, 226, 227, 24, 28, 93.67, 32, 401.1; 400/621, 621.1, 630; 428/43, 323; 493/396, 397, 399, 404, 363, 366, 355, 340; 283/67, 100, 102, 105, 71; 281/2, 12; 83/660, 348, 861, 863, 879, 880, 881, 886; 156/252

(56) References Cited

U.S. PATENT DOCUMENTS

| | | | | |
|---|---|---|---|---|
| 492,912 A | * | 3/1893 | Bright | 283/105 |
| 553,996 A | * | 2/1896 | Moore | 283/105 |

(List continued on next page.)

FOREIGN PATENT DOCUMENTS

| | | | |
|---|---|---|---|
| DE | 297 17 843 U | | 1/1998 |
| EP | 0 719 650 A | | 7/1996 |
| EP | 0 995 603 A2 | | 4/2000 |
| GB | 2048817 | | 12/1980 |
| JP | 5-341716 | | 12/1993 |
| JP | 7-61019 | | 3/1995 |
| JP | 7-195880 | | 8/1995 |
| JP | P7-306641 | | 11/1995 |
| JP | 8-90841 | | 4/1996 |
| JP | 08-216565 A | * | 8/1996 |
| JP | 11 277879 A | | 1/2000 |
| WO | WO 98 20447 A | | 5/1998 |
| WO | 98/20447 | | 5/1998 |

OTHER PUBLICATIONS

Paper Catalog, Exhibit A1, pp. 1 and 31–69 Jul. 1996.
Inoa Multi–card name, card size.
MJ–700V2C Reference Guide.
Canon, Color Bubble Jet Printer BJC–35v II Print Guide.
Command Manual for Macintosh (Ichitaro Ver. 5).

*Primary Examiner*—Eugene H. Eickholt

(57) ABSTRACT

A sheet-like printing medium with easy-separating means which enables one to easily separate the printing medium into separate portions. When an image is formed on the printing medium having easy-separating means disposed inside and entirely along the peripheral edge thereof, a print area is extended slightly to the peripheral edge beyond the easy-separating means. When the width of a non-print area left in the peripheral edge of the print area is separated at a part of the easy-separating means, an image is formed spaced from the sides of each of the non-print areas by a predetermined distance.

4 Claims, 18 Drawing Sheets

U.S. PATENT DOCUMENTS

| | | | | | |
|---|---|---|---|---|---|
| 635,731 | A | * | 10/1899 | Browne et al. | 283/105 |
| 1,442,056 | A | * | 1/1923 | Edmunds | 283/105 |
| 1,771,983 | A | | 7/1930 | Wandel | 428/43 |
| 2,121,203 | A | * | 6/1938 | Noble | 283/105 |
| 3,440,747 | A | | 4/1969 | Oliver | 428/43 |
| 3,565,463 | A | | 2/1971 | Taylor | 283/105 |
| 3,664,912 | A | | 5/1972 | Olson | 281/12 |
| 3,995,555 | A | | 12/1976 | Steward | 101/486 |
| 4,174,857 | A | | 11/1979 | Koza | 283/105 |
| 4,177,730 | A | | 12/1979 | Schrizer et al. | 101/485 |
| 4,220,272 | A | | 9/1980 | Danti | 493/365 |
| 4,298,647 | A | | 11/1981 | Cancio et al. | 428/43 |
| 4,324,823 | A | | 4/1982 | Ray, III | 428/202 |
| 4,617,215 | A | | 10/1986 | Telejco | 283/105 |
| 4,725,156 | A | * | 2/1988 | Proulx et al. | 400/630 |
| 5,029,506 | A | | 7/1991 | Glendening | 83/660 |
| 5,052,718 | A | * | 10/1991 | Gold | 283/105 |
| 5,090,733 | A | * | 2/1992 | Bussiere | 283/105 |
| 5,127,675 | A | * | 7/1992 | Moss | 283/70 |
| 5,198,275 | A | | 3/1993 | Klein | 428/43 |
| 5,238,269 | A | * | 8/1993 | Levine | 281/2 |
| 5,346,321 | A | | 9/1994 | Eudy | 400/621.1 |
| 5,351,993 | A | * | 10/1994 | Wright et al. | 283/105 |
| 5,423,732 | A | | 6/1995 | Coe | 493/363 |
| 5,428,423 | A | | 6/1995 | Clark | |
| 5,466,520 | A | | 11/1995 | Krallmann et al. | 428/323 |
| 5,484,167 | A | | 1/1996 | Donaldson et al. | 283/67 |
| 5,509,694 | A | | 4/1996 | Laurash et al. | 283/105 |
| 5,536,546 | A | | 7/1996 | Nash | 156/252 |
| 5,571,587 | A | | 11/1996 | Bishop | 428/43 |
| 5,573,825 | A | | 11/1996 | Brewster | 101/486 |
| 5,631,053 | A | | 5/1997 | Andersen et al. | 101/490 |
| 5,671,921 | A | * | 9/1997 | Quinlan | 283/105 |
| 5,780,133 | A | * | 7/1998 | Engstrom | 283/105 |
| 5,825,996 | A | * | 10/1998 | Davis et al. | 358/1.18 |
| 5,853,837 | A | | 12/1998 | Popat | 283/105 |
| 5,997,680 | A | * | 12/1999 | Popat | 156/252 |

* cited by examiner

PRINTING MEDIUM, MANUFACTURING METHOD OF THE SAME, AND PRINTING METHOD

This is a continuation of application Ser. No. 08/946,222 filed Oct. 7, 1997, now U.S. Pat. No. 6,173,649, the disclosure of which is incorporated herein by reference.

BACKGROUND OF THE INVENTION

1. Field of the Invention

The present invention relates to a printing medium and a method of manufacturing the same, and a printing method. More particularly, the invention relates to a printing medium and a method of manufacturing the same, and a printing method which are adaptable to an image recording or printing apparatus which holds printing media in forming images and requires such margins (non-print areas) to secure high precision medium in feeding the printing which is required to secure a high definition printing.

2. Background

Various devices and apparatuses for printing characters and images (sometimes referred to collectively as images) have been developed and put into practical use. Of the printing techniques thus far developed, the most advanced is the ink jet printing technique.

The quality of the image produced using the ink jet printing technique is inferior to that of the image produced by the conventional photographic printing technique. However, recently, the ink jet printing devices and the printing media used therein have been remarkably improved to produce a printed image of considerably high image quality.

Given recent improvements in the quality of the picture produced by the ink jet printing technique, attention has focused on the following five advantages unique to the ink jet printing technique:

(1) A complicated process for visualizing the image data is not required because the image is printed using ink directly on the printing medium.

(2) The ink jet printing technique uses ink droplets and, therefore, does not result in direct contact or impact with the printing head.

(3) Ink is deposited only on the necessary parts of the printing medium resulting in highly efficient utilization. Furthermore, the image printed on a printing medium, even if the medium is conventional paper, has a more professional look.

(4) The recurring cost for ink and printing media, e.g., paper, is extremely low, making the ink jet printing system economical.

(5) Finally, it is possible to deposit droplets of colored inks on the printing medium in a superimposed manner resulting in an image relatively high in quality.

In addition to the above listed advantages, the ink jet printing technique operates quickly. For these reasons, the application of this type of printing technique has become increasingly popular in printing activities ranging from business to home use. The market desires further improvements of the ink jet printer technology.

The ink jet based printer forms an image while moving a printing medium of a given size, such as greeting card or Christmas card, at a given speed. In the printer, a printing medium is held by a transporting roller which is disposed facing a print head by proper fixing means. In this state, the printing medium is intermittently transported in a vertical direction, and the print head is horizontally moved for printing when the medium transportation is stopped.

In the widely used ink jet based printer, non-print areas (areas on the printing medium having no print) or spaces are present in the leading, trailing and side portions of the printing medium having varying dimension depending on the type of the printing medium transporting means. Given the present stage of printer technology, these non-print areas are essential to firmly support and transport the printing medium within the printer.

In most printers, it is impossible to set the size of the leading non-print area to be equal to lo that of the trailing non-print area. In the image forming, recording or printing device widely used now, the trailing non-print area, which is unavoidable, is set at approximately 10 to 15 mm.

In order to ensure a higher quality look of the image on the printing medium, large non-print areas or non-print areas having different dimensions should be avoided. Particularly, in pictures printed by recent advanced ink jet based printing, image forming, or recording devices having a print quality comparable to photographs, such defects as a result of having these non-print areas decreases the value of the high quality pictures.

SUMMARY OF THE INVENTION

Accordingly, an object of the present invention is to produce an image of high quality on a printing medium regardless of the marginal space formed around the printed image.

Another object of the present invention is to provide a printing medium in which the non-print dimensions are easily set at desired values or zero if necessary.

An additional object of the present invention is to provide a method for manufacturing a printing medium in which the value of the printing medium on which a picture is printed are not degraded by the presence of marginal non-print areas.

A further object of the present invention is to provide a printing method in which the quality of a printed printing medium is not degraded by the presence of non-print (space) areas in the margins.

According to an aspect of the present invention, there is provided a novel and unique printing medium which may accept ink droplets. This printing medium is provided with easy-separating means which enables one to easily separate the printing medium into at least two parts. Therefore, a sub-part of the printing medium is easily separable from a main part thereof.

According to another aspect of the present invention, there is provided a first method for manufacturing printing media which includes a process for separating a plurality of printing media with easy-separating means from a sheet at one time while leaving one part of each printing medium connected to the sheet. Therefore, a plurality of printing medium with easy-separating means may be manufactured efficiently.

According to yet another aspect of the invention, there is provided a second method for printing an image on a sheet-like printing medium having easy-separating means provided inside and entirely along the peripheral edge of the sheet-like printing medium for separating the peripheral edge from the printing medium. When an image is formed on the sheet-like printing medium, a print area is formed extending somewhat beyond the easy-separating means to the peripheral edge of the sheet-like printing medium. Therefore, employing this method will result in a printed printing medium without non-print areas (blank margins) as the non-print areas may be separated from the print area along the easy-separating means at the completion of the printing process.

According to still another aspect of the invention, there is provided a third method for printing an image on a sheet-like printing medium having easy-separating means for separating the printing medium along the easy-separating means into two parts so that when forming an image on the printing medium, and the non-print areas left around the peripheral edge of a print area is separated at a part of the easy-separating means, the image is formed at a predetermined distance from the easy-separating means equidistant from at least the opposite sides of each of the non-print area. As a result, the printed printing medium has reduced non-print areas, and the print area containing the printed image is disposed relative to the non-print areas in a well balanced fashion.

Thus, a printing medium is provided with easy-separating means which enables one to easily separate the printing medium into at least two parts, that is, having a part which is easily separable from a main part thereof. Accordingly, a form of the non-print areas of the printed printing medium can be freely set in a desired form after the printing on the printing medium.

For example, if the portion or area of the printing medium enclosed by the easy-separating means is rectangular in shape, the print area may easily be shaped to be rectangular. If the printing medium is set in a printing apparatus such that it is advanced by its trailing part having the widest cutout portion (4), the conventional printing apparatus may be used for the printing on the printing medium of the invention.

Thus, the positional relation among the easy-separating means, the peripheral edge of the print area and the peripheral edge of the printing medium is specified as mentioned above. Accordingly, the invention provides a high quality printing medium in which a print area is disposed relative to a non-print area in a well balanced fashion without any complicated means or operation, by merely separating the unnecessary portions along the easy-separating means.

In setting the printing medium in a printing apparatus, the printing medium may be advanced with its trailing edge having the widest cutout portion (4) so that a conventional printing apparatus may be used for printing on the printing medium of the invention. The distance, or the width of the non-print area, from the peripheral edge of the image in the trailing edge of the printing medium to the easy-separating means may be equal to the width, or distance from the edge of the image to the edge of the printing medium, of the non-print area in the front part (viewed in the medium advancing direction).

In this case, by separating the printing medium along the easy-separating means after printing the image, the resultant printed printing medium has reduced non-print areas results in a well balanced visual presentation.

In an ink jet printer, particularly a color ink jet printer, the printing is performed at high precision and high resolution. Therefore, extremely high precision is required for the medium feeding operation. In this type of printer, the print head is of the multi-nozzle type and large in size. For this reason, the non-print areas are set to be relatively large. However, in the printing method of the invention, after printing, unnecessary portions may easily be separated from the printing medium by the easy-separating means, thereby reducing the width of the non-print areas. As a result, in the printed printing medium, the print area is disposed to the non-print areas in a well-balanced fashion.

If, after the unnecessary portions are removed, the width of the non-print areas left, having been reduced as the result of the separation by the easy-separating means, is substantially equal to the width of the remaining non-print areas, the printed printing medium will have a more attractive appearance.

Furthermore, by separating the printing medium by the easy-separating means after the printing, a printed printing medium without the non-print areas (or non-print space around the perimeter) can be obtained extremely easily.

DETAILED DESCRIPTION OF THE PREFERRED EMBODIMENTS

A printing medium constructed according to the present invention will be described with reference to FIGS. 1 to 13 and FIG. 22.

Figure 1:
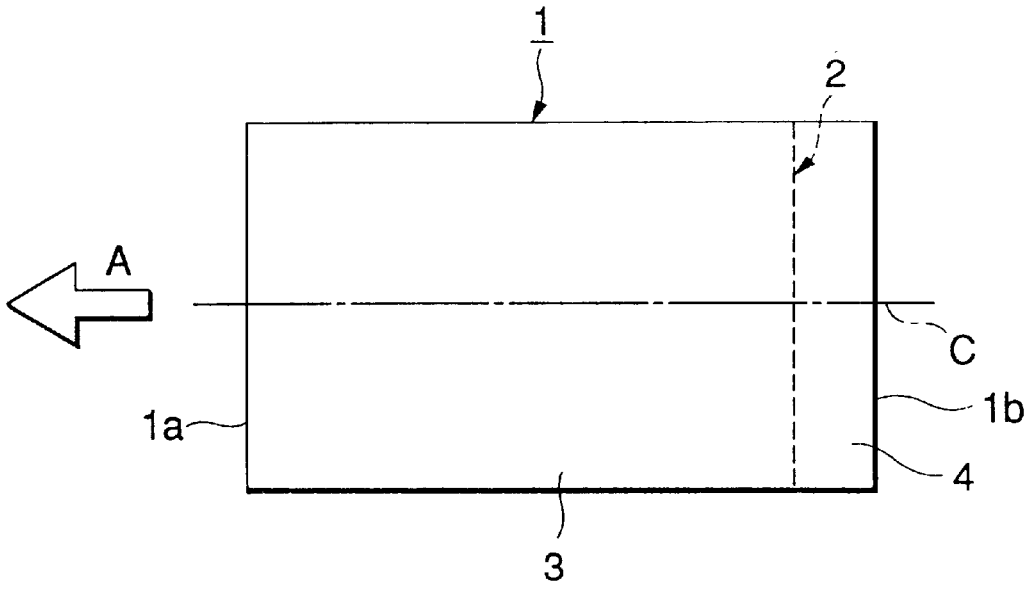
FIG. 1 is a plan view showing a printing medium according to the present invention.

FIG. 1 shows a preferred embodiment of a printing medium according to the present invention. As shown, a printing medium, or an image forming or recording medium, e.g., a sheet of paper, is provided with an easy-separating means 2. The easy-separating means 2 is provided for easily separating a portion of the printing medium I from a main portion thereof.

The easily-separating means should allow separation by hand of the cutout portions from the main portion. The easy-separating means may be a continuous cut line or a dotted (or seam-like) cut line. Each cut line may be formed such that the depth of the cut or cuts is equal to the full thickness of the printing medium. That is, the cut or cuts of the cut lines penetrate through the printing medium. Alternatively, the cut line may be formed so that the depth of the cut or cuts is less than the thickness of the printing medium. That is, the cut or cuts of the cut lines do not fully penetrate the printing medium.

In a printing medium in which the easy-separating means 2 is a dotted cut line consisting of a number of cuts or perforations which are formed in the printing medium in a straight line, the depth of each cut of the seam-like cut line may be equal to the full thickness of the printing medium. Alternatively, the depth of each cut may be shorter than the thickness of the printing medium. In the printing medium in which the easy-separating means 2 is a seam-like cut line, the length of each non-cut part of the seam-like cut line which is located between the adjacent cuts and the diameter or width of each cut may be properly selected.

More specifically, in selecting the length and diameter or width of those parts of the seam-like cut line, the only requirement is that the seam-like cut line is not broken within the printer but may easily be broken by hand. In a case where the easy-separating means 2 is a seam-like cut line, the length of each non-cut part and the diameter or width of each cut of the seam-like cut line, is 1 mm or shorter (preferably 0.5 mm or shorter). That is, the seam-like cut line consists of a number of micro-cuts and non-cut parts in an alternating and linear array.

In the printing medium having the seam-like cut line of micro-cuts, burrs along the seam-like cut line are avoided thus, increasing the value of the printed matter or printing medium.

The method and means for forming micro-cuts are well known in the art. For example, the micro-cuts may be made using a Thomson type punching machine SBDS or MFS-820M (manufactured by Heidelberg, and handled by Kanno Seisakusho).

In the printing medium having a continuous cut line, some connecting means must be used for connecting a main portion 3 of the printing medium to a cutout portion 4. A greater part of the continuous cut line may be formed so that the depth of the cut of the cut line is equal to the full thickness of the printing medium, that is, the cut is formed by fully penetrating the printing medium. The main portion 3 may be connected to the cutout portion 4 in a manner that the continuous cut line includes some non-cut portions that are formed at the ends of the printing medium.

The easy-separating means 2 may be contoured such that the main portion 3 separable from the cutout portion 4 may take any form. An example of such is a printing medium 1C shown in FIG. 22. In this printing medium, the easy-separating means 2 are contoured so as to form general main portions 3 having various shapes like a circle, ellipsis, parallelogram, heart, and the like.

The printing medium of the invention may be used in an ink jet printer as with a conventional printing medium. It is preferable that the printing medium 1 and the printer are configured so that the cutout portion 4 of the medium is included within the broad printing area that is unavoidably caused. In a preferred form of the invention, in order to include the cutout portion 4 of the printing medium 1 within the printing area, a color, pattern, note, and the like are printed in advance on the cutout portion 4 to instruct a user to set the printing medium to the printer in a proper direction. Since the cutout portion 4 is cut off from the main portion 3 and discarded, the color, pattern, note, and the like printed on the cutout portion 4 do not form part of the final printed matter or printing medium.

Figure 2:
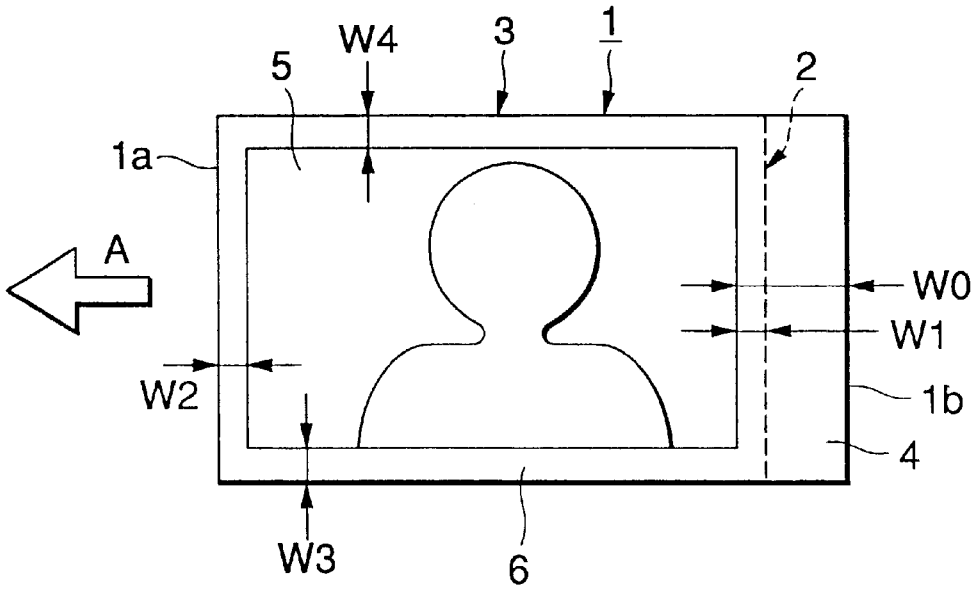
FIG. 2 is a plan view showing the surface of the FIG. 1 printing medium having a picture printed thereon and marginal non-print areas around the printed picture.

FIG. 2 is a diagram showing a printing medium of the present invention on which a picture is printed. In the printing medium, the main portion 3 includes a print area 5 and a non-print area 6 surrounding the print area 5.

The width of the non-print area may be selected so as to provide a well-balanced visual presentation of the printed matter. In this case, the width of the non-print area may be different for each side of the non-print area. That is, all the sides of the non-print area, right and left and the upper and lower sides thereof, may be uniform in their width, or have fixed width values.

The print area 5 and the non-print area 6 may be set by properly positioning the easy-separating means 2 or properly processing the image information to be printed, as a matter of course.

After the printing for the printing medium 1 is completed, the cutout portion 4 is separated from the printing medium 1 along the easy-separating means 2. In this case, the cutout portion may be easily separated from the main portion by hand. If the printing medium is repeatedly bent several times along the easy-separating means 2, separation is made more easily.

Figure 3:
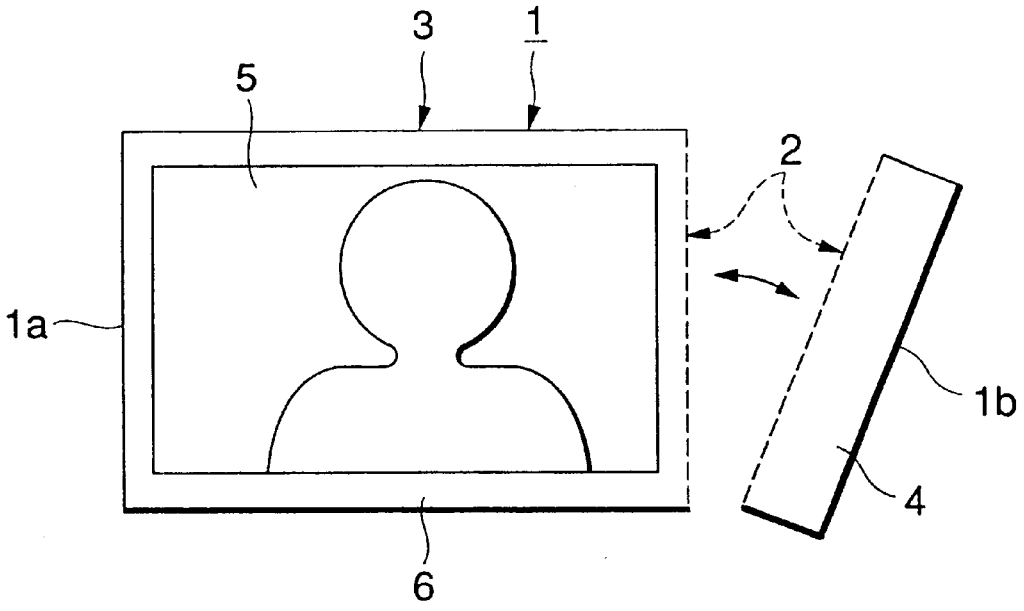
FIG. 3 is a plan view showing a main portion of the printed printing medium of FIG. 2 and a separable portion to be separated from the main portion of the printing medium.

FIG. 3 shows a printed image on a printing medium after the cutout portion of the printing medium is separated from the main portion thereof.

As seen from the printed medium main portion separated from the cutout portion 4, the non-print area is disposed around the print area 5 in a well-balanced fashion, providing a good visual presentation. The printed matter or the printed printing medium shown in FIG. 3 resembles a photograph, and when printed in accordance with the present invention, its quality is greatly enhanced.

The printing medium according to the present invention may be a printing medium having a glossy layer and/or an ink accepting layer. In the preferred form of the invention, a printing medium consists of a substrate and a glossy layer and/or an ink acceptable layer formed on one of the surfaces of the substrate. If the printing medium is provided with easy-separating means of a cut line, the depth of the cut of the cut line is equal to or lesser than the full thickness of the substrate. In this case, it is necessary that the cut line is formed in the substrate reaching the glossy layer and the ink acceptable layer.

If the cut of the cut line reaches the glossy layer and the ink acceptable layer, the ingredients of those layers will be scattered in the form of powdery particles possibly soil the printing medium and the printer inside. The printing medium may be constructed such that the glossy layers and the ink acceptable layers are formed on both sides of the substrate. In this case, it is preferable that the easy-separating means 2 is formed on the side of the substrate of the printing medium which produces less powdery particles of the ingredients of those layers.

In a case where the easy-separating means 2 of the printing medium 1 has cuts, the cuts are preferably formed so as not to cut the end of the printing medium. A model of the seam-like cut line thus formed is illustrated in FIG. 4.

Figure 4:
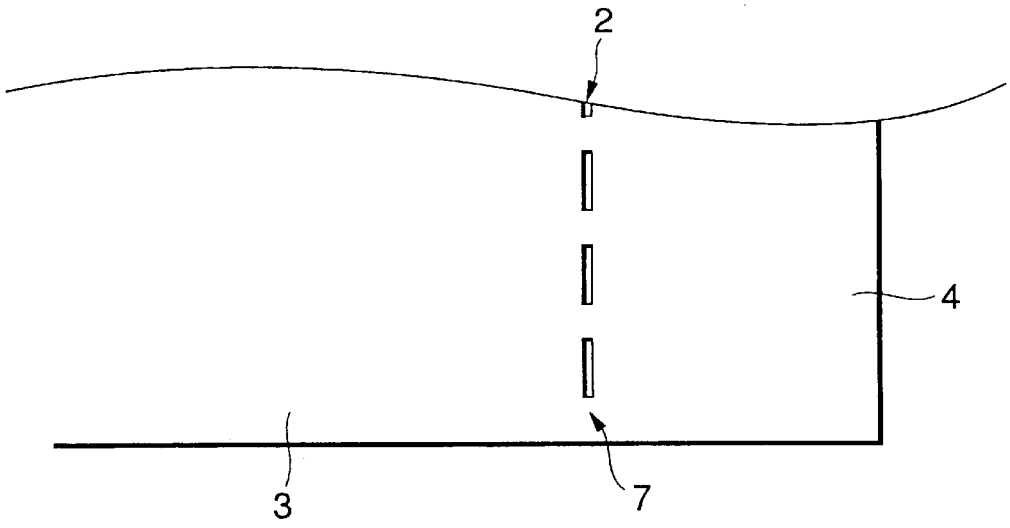
FIG. 4 is an enlarged view of an end of a printing medium provided with easy-separating means where the easy-separating means of the printing medium shown in FIG. 1 is formed without cutting the end of the printing medium at its edge.
Figure 5:
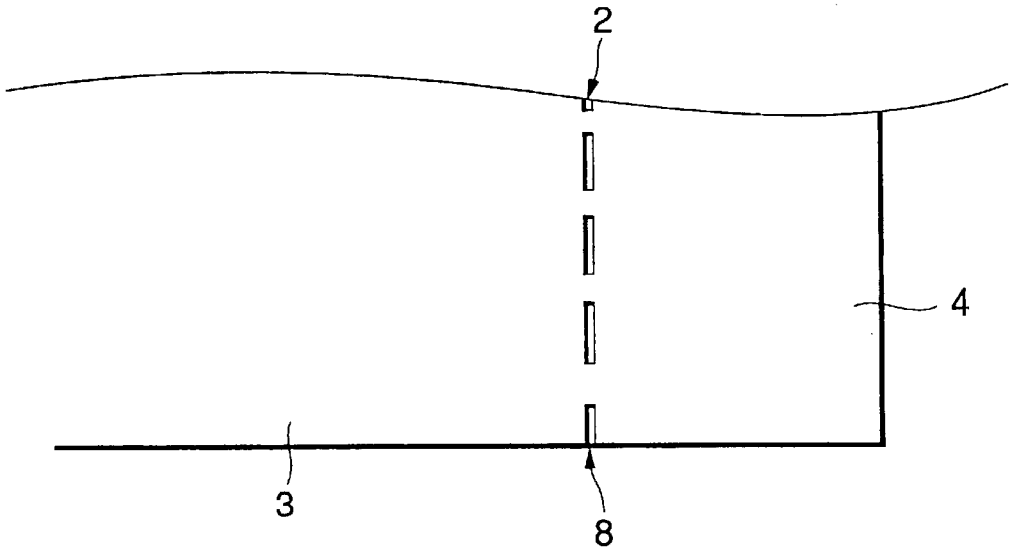
FIG. 5 is an enlarged view of an end of the printing medium of FIG. 1 where the edge of the printing medium is cut.

FIG. 4 is an enlarged view showing an end portion of a printing medium 1 whose easy-separating means 2 is the seam-like cut line. In the figure, a seam-like cut line 2 is formed not cutting the end of the printing medium. A main portion 3 of the printing medium is connected to a cutout portion 4 by a portion 7. In the case of FIG. 5, a seam-like cut line 2 cuts the end of the printing medium to form a cut 8. If a printing medium with this type of cut is set to some types of printers, the cut will be caught by a member of the printer to possibly cause an improper feeding of the printing medium. For this reason, the seam-like cut line 2 as shown in FIG. 4 which forms no cut at the end of the printing medium is preferable. The non-cut part at the edge of the printing medium is preferably at least 0.1 mm, and more preferably 0.2 mm or longer. For the structure of the printer of the type which accepts any type of printing medium whose end is cut by the seam-like cut line without any medium feeding trouble, the printing medium having the seam-like cut line as shown in FIG. 5 may be considered to be within the scope of the present invention.

Figure 6:
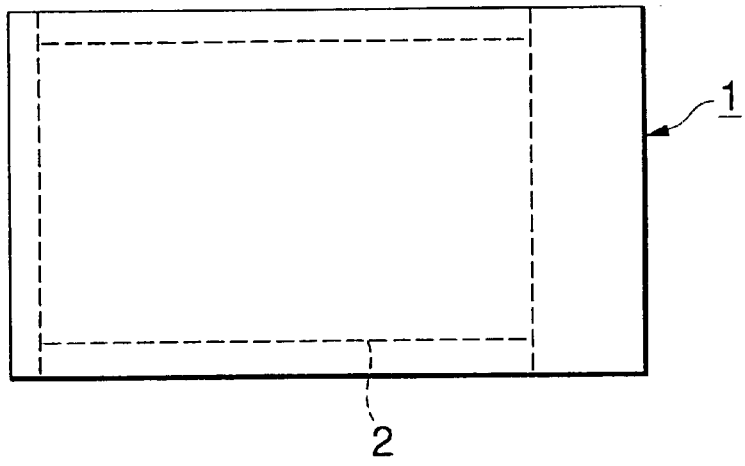
FIG. 6 is a plan view showing a printing medium according to another embodiment of the present invention in which the upper and lower horizontal easy-separating means bridge the right and left vertical easy-separating means.

Another preferred embodiment of the present invention is shown in FIG. 6. As shown, in a printing medium 1 of the embodiment, easy-separating means 2 is formed along the boundary between a print area and a non-print area.

Figure 7:
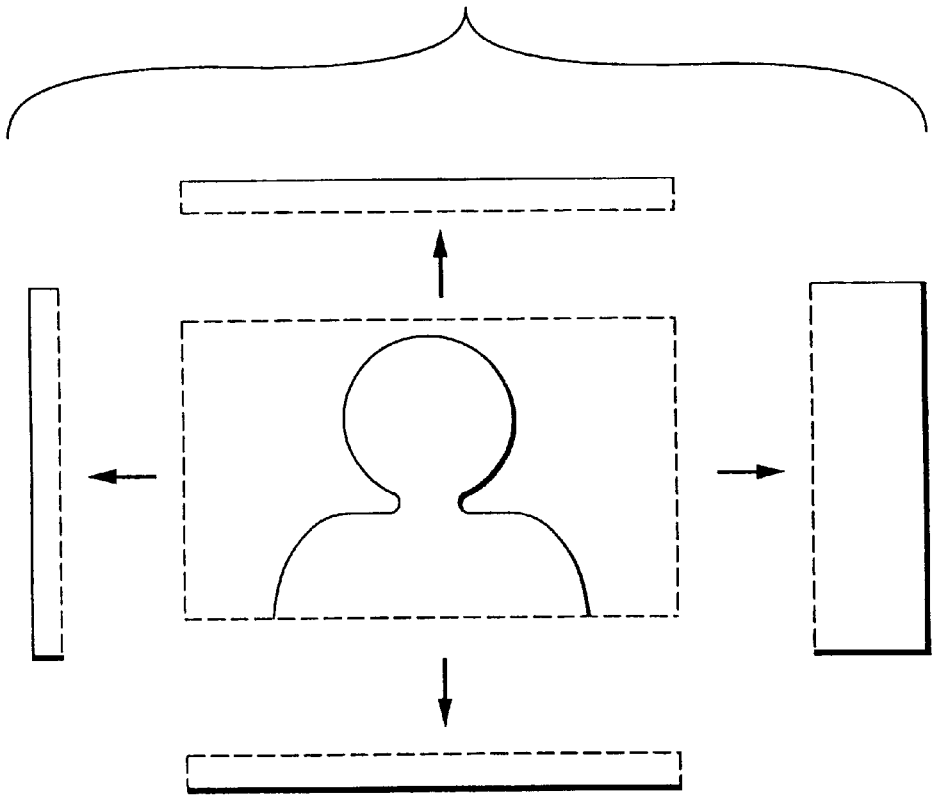
FIG. 7 is a plan view showing a state where an image is printed on the FIG. 6 printing medium having the non-print areas separated from the print area along the easy-separating means.

The printer prints on the printing medium 1 by a printing method of the invention, which will be described later. After the printing, a non-print area of the printing medium is cut off from a print area along the easy-separating means 2, as shown in FIG. 7, resulting in a printed image on a printing medium which includes only the print area.

Figure 8:
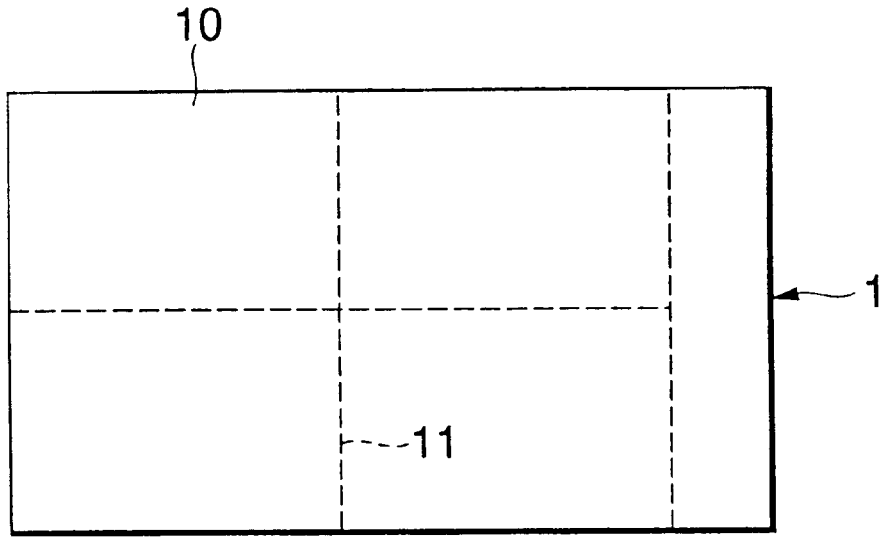
FIG. 8 is a plan view showing a printing medium according to another embodiment of the present invention in which easy-separating means are provided so as to separate a print area into a plurality (four) of separable portions or print areas.

In a modification of the embodiment under discussion, as shown in FIG. 8, easy-separating means 11 may be formed so as to part a print area of the printing medium into a plurality of small print areas 10. The modification is able to easily form a plural number of printed matters on a single printing medium 1.

Figure 9:
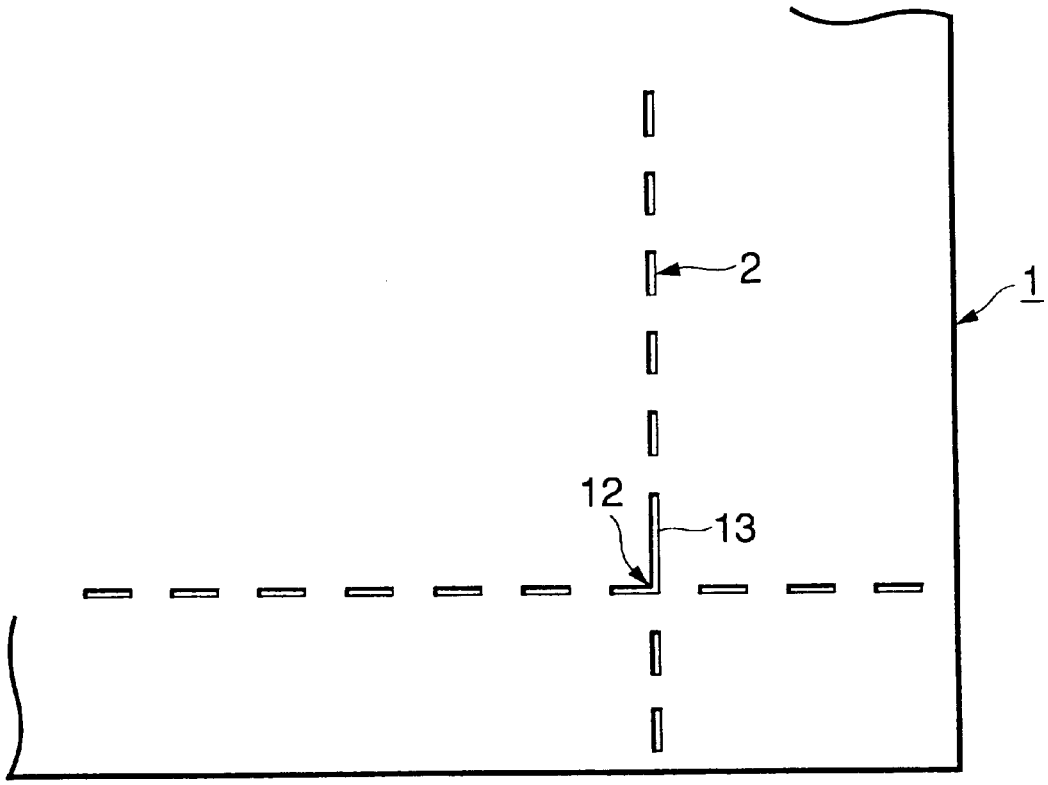
FIG. 9 is an enlarged view showing a printing medium in which a cut is formed at the intersection of cut lines so that the cut extends from the intersection in the direction of one of the cut lines that intersect and has a depth to the full thickness of the printing medium.

When the easy-separating means consists of continuous cut lines or seam-like cut lines which intersect, it is preferable to locate the intersection of the cut lines at the cut parts of the cut lines as shown in FIG. 9.

It is also preferred that a cut is formed at the intersection of the cut lines so that the cut extends from the intersection in the direction of its respective cut line and penetrates to the full thickness of the printing medium. This cut is referred to as the longer cut. In the case of FIG. 9, a cut 13, which penetrates the full thickness of the printing medium, is provided in the direction of one of the seam-like cut lines. When a printed matter is cut off from the printing medium 1 along the easy-separating means, the intersection 12 forms a corner of the printed matter separated from the rest of the printing medium. Therefore, the printed matter has a clean cut corner. The length of the longer cut 13 is longer than one of the cuts forming the seam-like cut line, and is set preferably at such a length as not to adversely affect the medium's transportation in the printer.

Figure 10:
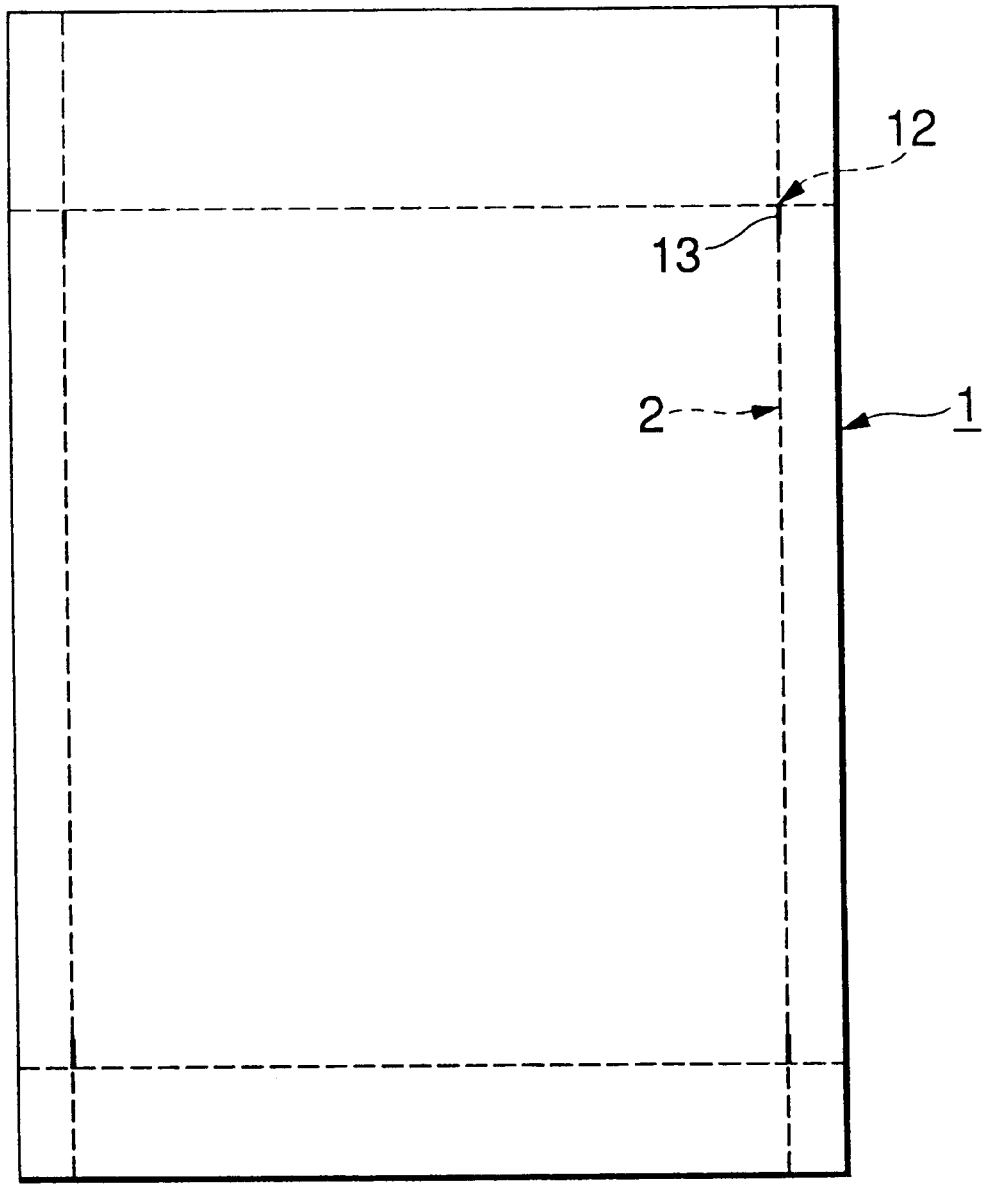
FIG. 10 is a plan view of a printing medium in which seam-like cut lines intersect and longer cuts (indicated by numeral 13) are formed at four corners of the printing medium.

FIG. 10 shows a printing medium 1 in which seam-like cut lines intersect at four corners, and longer cuts 13 are formed at four corners.

Figure 11:
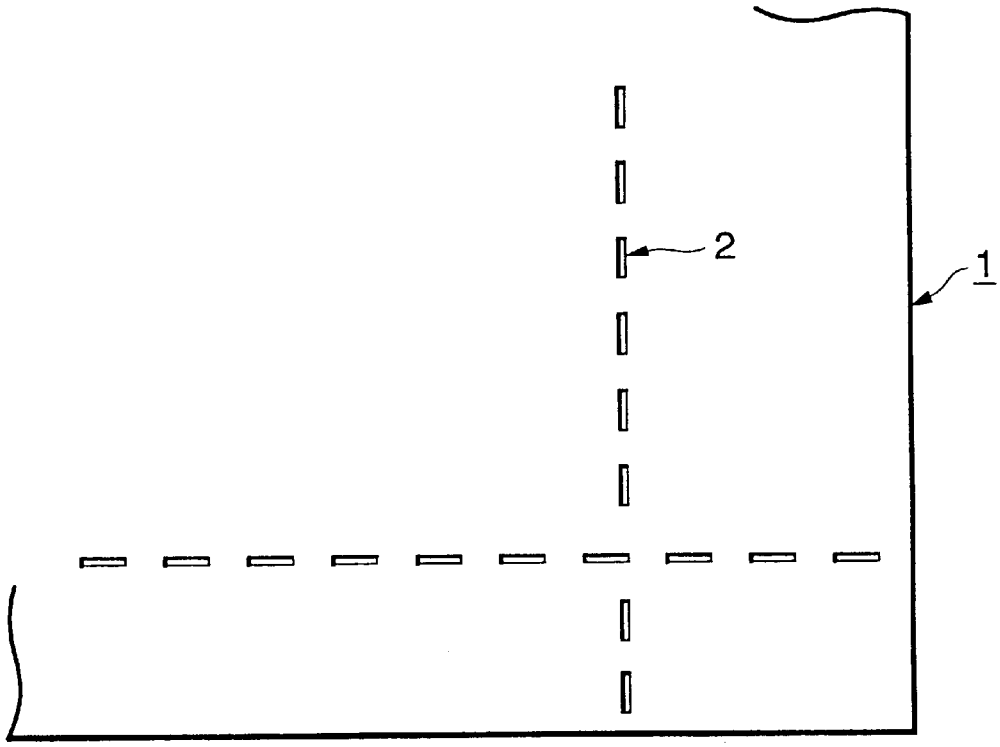
FIG. 11 is a plan view showing a printing medium in which the cuts of seam-like cut lines do not intersect.

A printing medium 1 in which the cuts of seam-like cut lines do not intersect as shown in FIG. 11 also falls within the scope of the present invention. Here, the printed image on a printer medium having clean cut corners can be obtained by properly selecting the pitch of the cuts of the seam-like cut line, the depth of the cuts, and the material of the printing medium.

Figure 12:
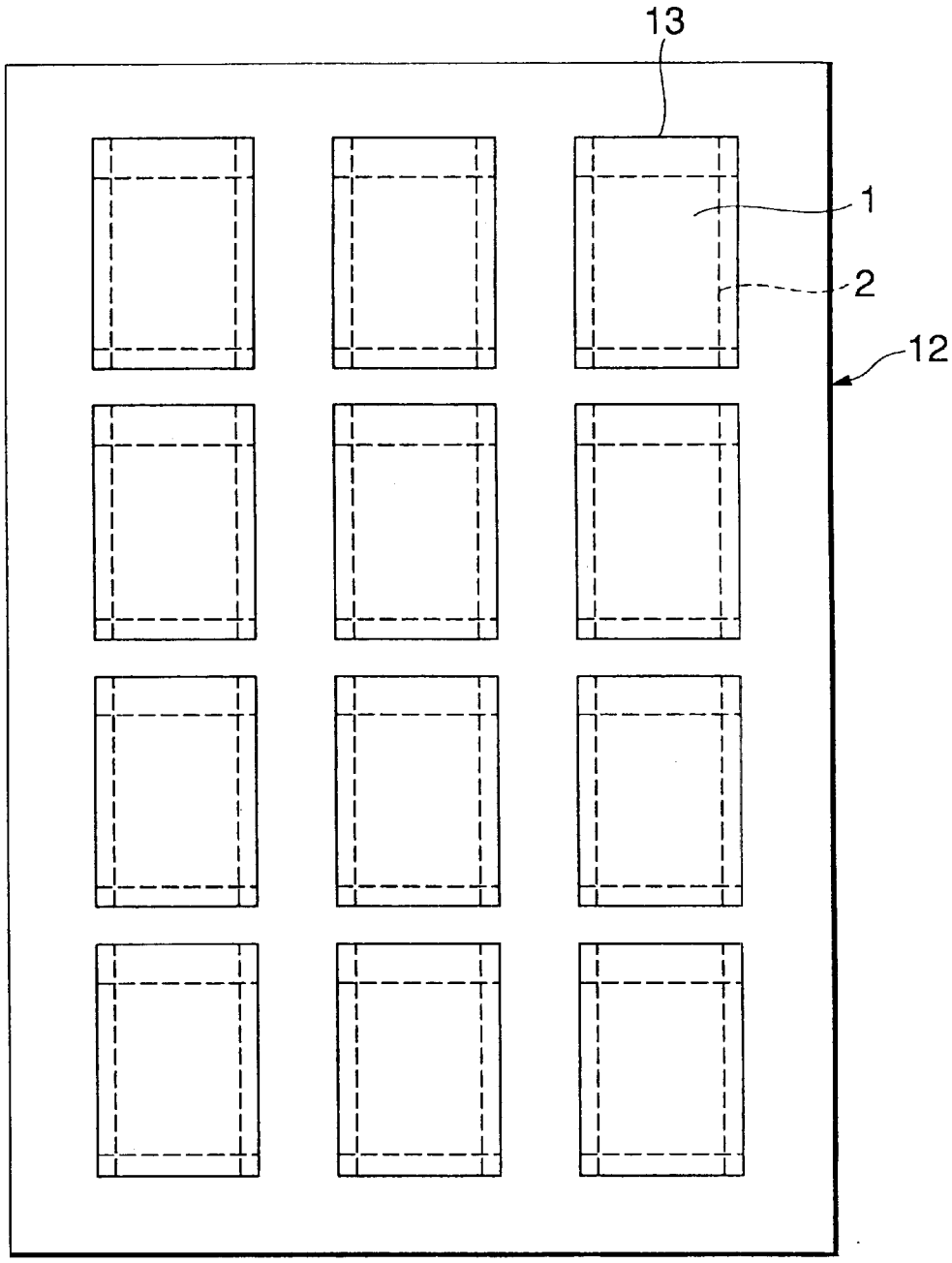
FIG. 12 is a plan view useful in explaining a method of manufacturing printing media according to the present invention, the view showing a large sheet where a plurality of printing media having easy-separating means are cut out of the sheet at once (each printing medium is separated from the sheet along a line 13 while portions 14 are left)

To produce the printing media 1 of the invention, it is preferable to cut out a plural number of printing media from a single sheet at one time. A specific example of this is illustrated in FIG. 12. As shown, a plural number of printing media may be cut out of a large sheet. In this example, the large sheet is cut along line 13 to form printing media, and easy-separating means 2 is formed in each printing medium. In this case, it is preferable that the printing media 1 remain connected to the sheet 12 by at least one part 14 in order to improve the working efficiency. In other words, in cutting the large sheet along the square line 13, it is preferable to avoid completely separating the printing media 1 from the large sheet 12.

Figure 13:
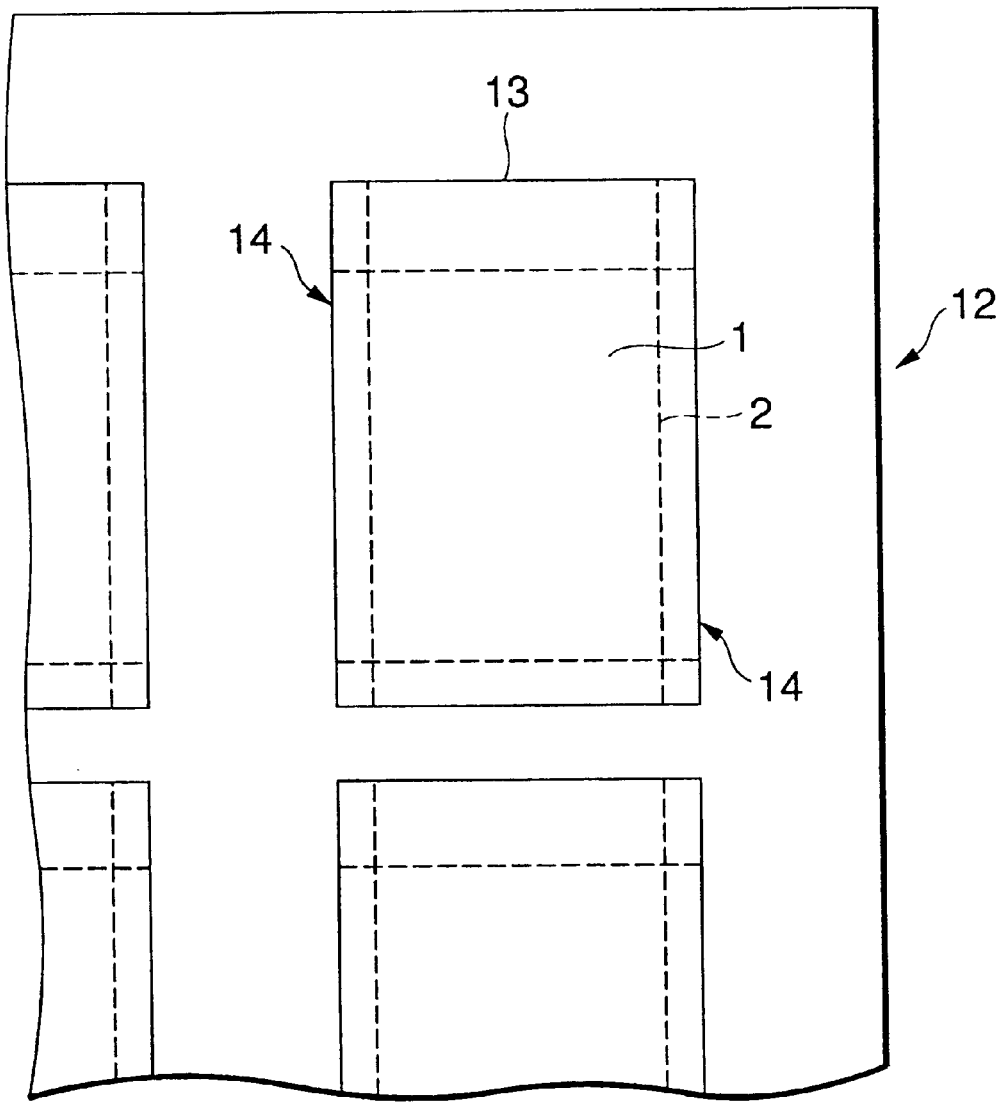
FIG. 13 is an enlarged view showing a part of the sheet of FIG. 12.

After the large sheet is cut along line 13 and the easy-separating means 2 are formed in each printing medium, the sheet 12 is moved to another place where the printing media are individually separated from the sheet 12. This process is preferable to increase the working efficiency. FIG. 13 shows an enlarged view of a part of the FIG. 12 illustration.

As shown in FIG. 13, each printing medium 1 is connected to the sheet 12 by the parts 14 that are left without being cut in cutting the sheet along the line 13.

In an additional preferred embodiment of the present invention, the printing medium L-may take the form of a label sheet with an adhesive layer. In a specific form, an adhesive layer is formed over the surface of the printing medium 1, which is opposite to the surface bearing a print area thereon, and having a release paper layered on the adhesive layer. After printing on the printing media, each main portion is cut out of each printing medium along the easy-separating means, and the release paper is removed from the main portion so that it bonded to the surface of another member. The design must be such that the presence of the adhesive layer and the release paper does not obstruct the function of the easy-separating means. Easy-separating means may be provided in the adhesive layer and the release paper at the locations thereof corresponding to the easy-separating means of the printing medium.

A printing method according to the present invention will be described with reference to FIGS. 14 to 18, and FIG. 22.

Figure 14:
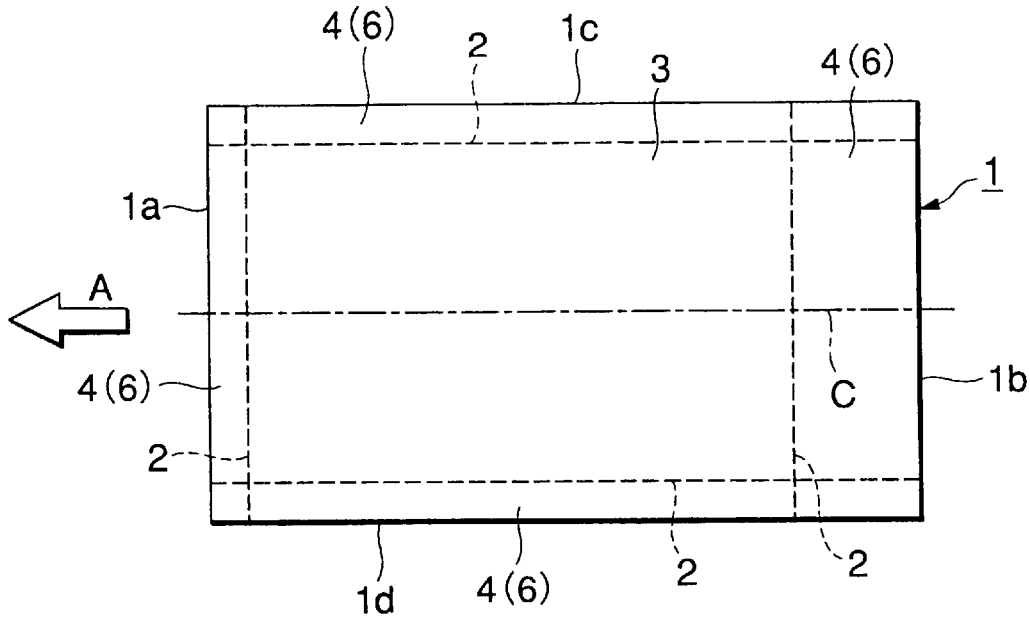
FIG. 14 is a plan view showing a printing medium used for explaining a printing method according to the present invention.
Figure 15:
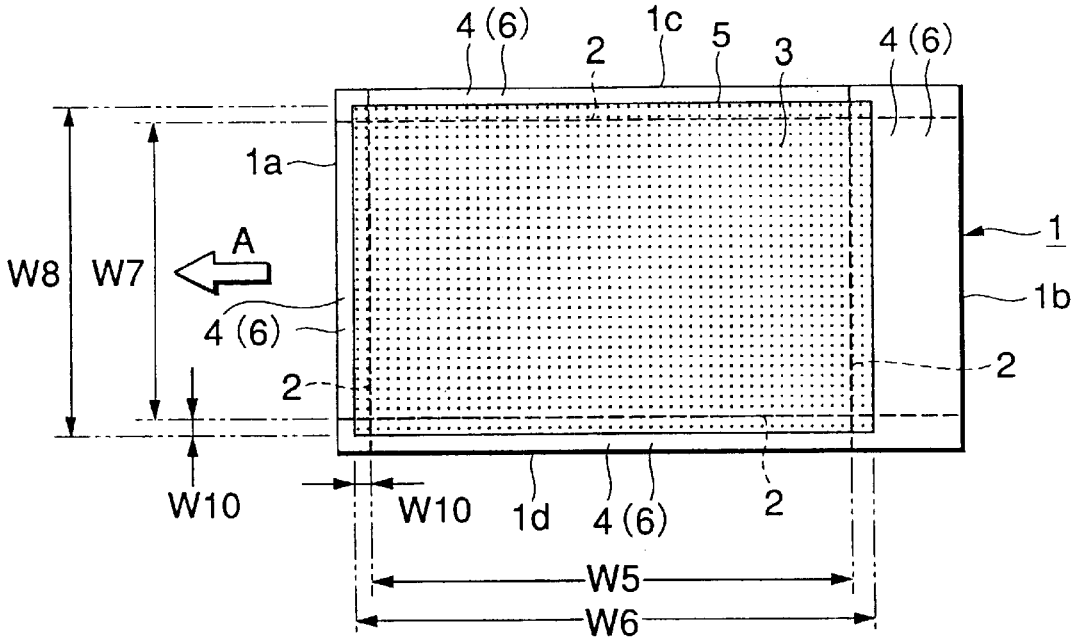
FIG. 15 is a plan view showing the FIG. 14 printing medium on which an image is printed.
Figure 16:
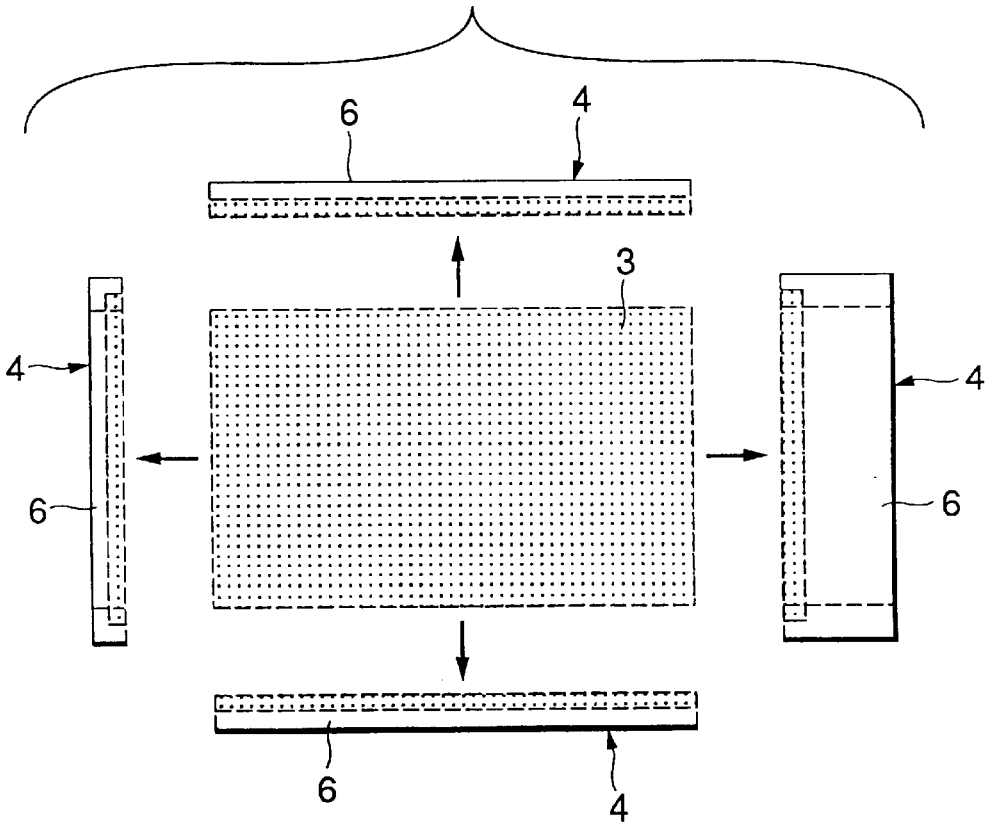
FIG. 16 is a plan view showing the FIG. 15 printing medium after separable portions are separated from a main portion of the printing medium.
Figure 17:
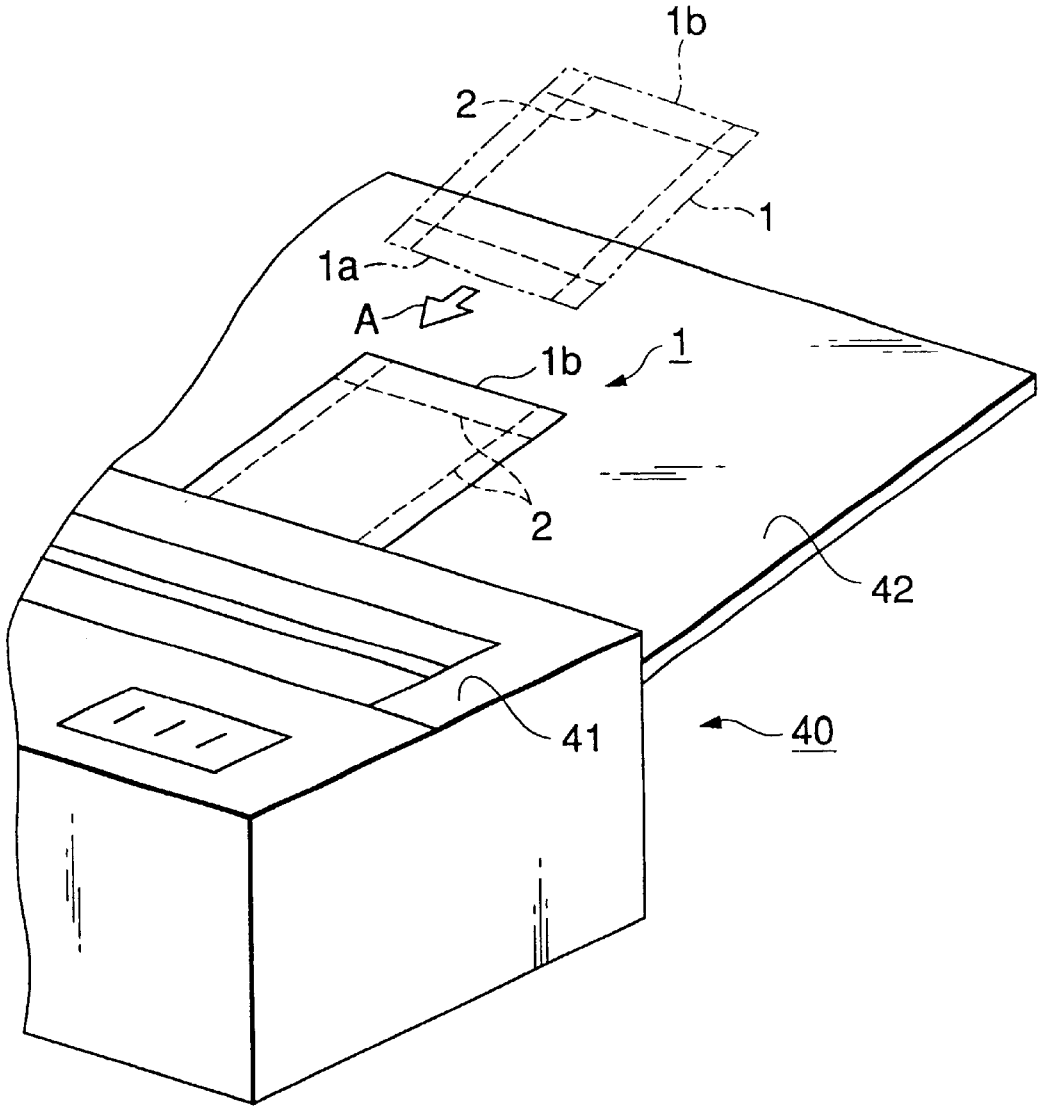
FIG. 17 is a perspective view showing a printing apparatus in which the FIG. 14 printing medium is placed.

FIG. 14 is a plan view showing a printing medium (resembling the printing medium shown in FIG. 10) used for the printing method of the invention. FIG. 15 is a plan view showing the printing medium of FIG. 14 on which an image is formed. FIG. 16 is a plan view showing a state of the printing medium in which cutout portions are separated from a main portion. FIG. 17 is a perspective view showing a state in which the FIG. 1 printing medium is placed in an image recording apparatus or a printer.

The printing medium discussed in the present embodiment is a postcard or another card equal in size to the post card. A printing medium 1, like a rectangular sheet, is illustrated in FIG. 14. As shown, easy-separating means 2 is provided inside and entirely along the edge of the printing medium l. A peripheral portion (cutout portion 4) outside the easy-separating means 2 is separable from a main portion of the printing medium. Four linear easy-separating means 2 are provided along the shorter sides (sides 1*a* and 1*b*) and the longer sides 1*c* and 1*d* of the printing medium.

The printing method of the invention is applicable not only to the ink jet printing method but also to the thermal transfer printing method, the sublimation transfer printing method, and the like. Preferably, however, it is used with the ink jet printing method, and more preferably with the color ink jet printing method.

If the image recording apparatus 40 is based on the ink jet system, the printing medium may be any form of quality paper, bond paper, PPC paper, envelope, label, dedicated coat paper having a special ink acceptable layer formed thereon, OHP film, glossy paper (film), and the like. Furthermore, there are no special limitations in the size of the printing medium 1. For example, the size of the printing medium may range from the name card size to the A0 size.

A method for recording or printing an image on the thus constructed printing medium 1 will be described. In the printing method description to follow, the image recording or printing apparatus 40 shown in FIG. 17 is used.

A printing medium 1 is placed on a paper tray 42 for storing printing media. The paper tray 42 is attached to a main body 41 of the printing apparatus 40 while being extended outwardly from the main body. At this time, the printing medium 1 is set to the printing apparatus such that the side having the widest cut out portion of the printing medium is located at the trailing edge of the printing medium when viewed in the advancing direction (direction of an arrow A) of the-printing medium. In the printing apparatus 40, a print area (area indicated by a dotted image in FIG. 15, and defined by W7 (vertical length)×W6 (horizontal length)) is set to be somewhat larger than an area (defined by W8 (vertical length)×W5 (horizontal length)) enclosed by the easy-separating means 2. The print area 5 is set such that its outer edge extends slightly to all the cutout portions 4. The width W10 of the part of the print area which is defined as the distance between the edge of the printed image 5 and the easy-separating means 2 should be 10 mm or shorter, preferably 5 mm or shorter, and even more preferably 3 mm or shorter. Furthermore, the width W10 should be substantially uniform over the entire periphery of the print area 5.

After the printing medium 1 is thus set to the printing apparatus 40, the apparatus is operated. The printing medium 1 is transported into the apparatus. On a predetermined location (on the platen), the upper and lower side edges (along the sides 1*c* and 1*d*) of the printing medium, and the rear edge are properly held along the center line C (FIG. 1). An image is then formed or printed on the printing medium. A print area 5 (shown here as a dotted image), which extends slightly to the cutout portions 4 from the main portion 3 (enclosed by the easy-separating means 2), is formed as shown in FIG. 15.

Thereafter, the cutout portions 4 are separated from the main portion 3 along the easy-separating means 2, resulting in a main portion 3 of the printing medium having no non-print areas 6.

Figure 18:
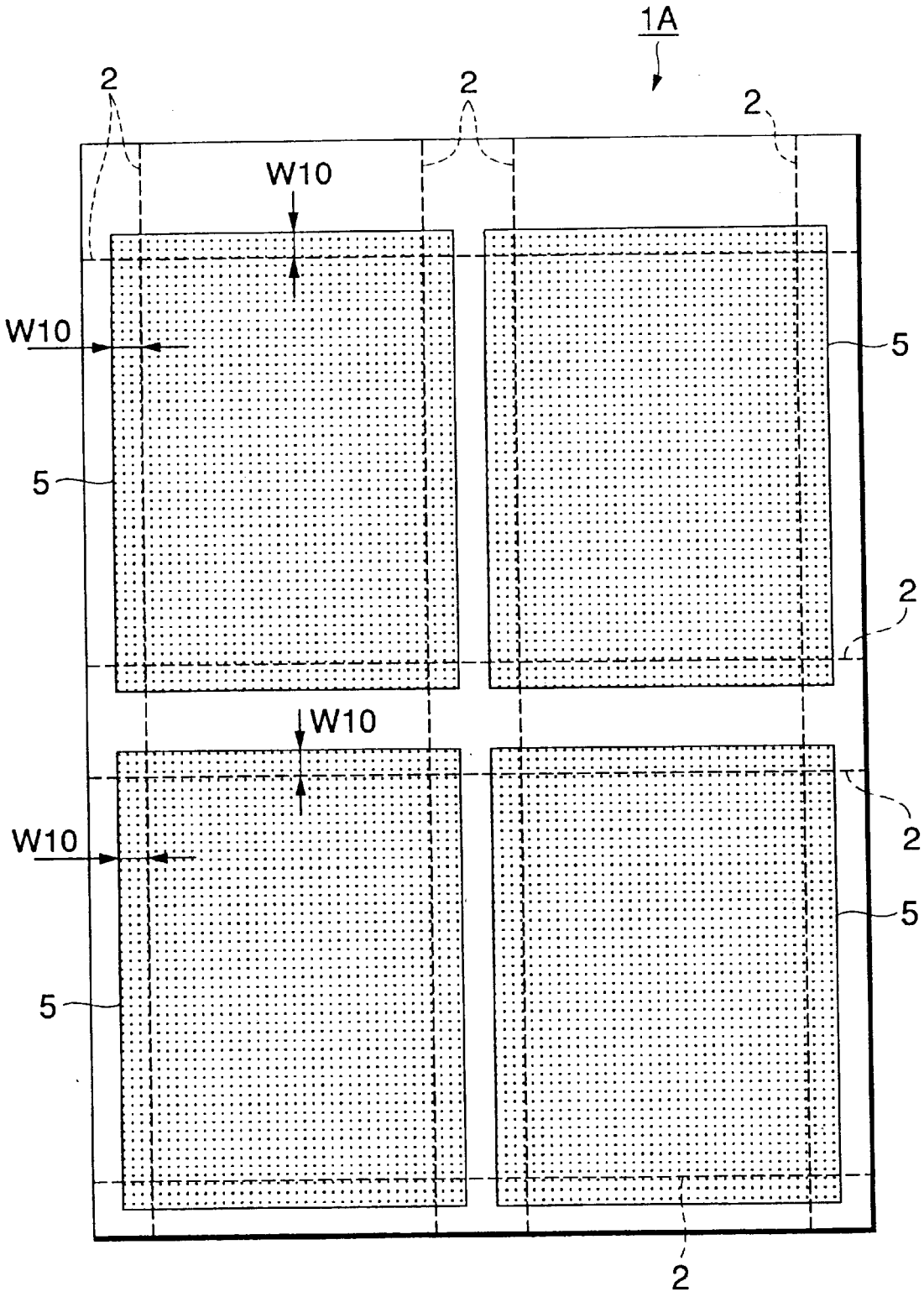
FIG. 18 is a plan view showing a printing medium useful in explaining a printing method according to another embodiment of the present invention.

While one print area 5 is included in the printing medium 1 in the above embodiment, a plurality of print areas may be included in one sheet of printing medium as shown in FIG. 18.

In a printing medium 1A shown in FIG. 18, two easy-separating means 2 are formed along the length of the printing medium in the central part, and one easy-separating means 2 is formed close to and along one of the sides along the length of the printing medium while another easy-separating means 2 is formed along the other side. Furthermore, two easy-separating means 2 are formed along the width of the printing medium in the central part, and one easy-separating means 2 is formed close to and along one of the sides along the width of the printing medium while another easy-separating means 2 is formed close to and along the other side. With the easy-separating means 2 thus formed, the printing medium 1A is separated into a plurality of portions (four large rectangular portions in FIG. 5 are used for image forming or print areas).

These rectangular regions, for example, may be designed to have the size of a name card.

In the printing medium 1A, images are formed in the largest rectangular portions of those portions separated along the easy-separating means 2. In the case of FIG. 18, four print areas 5 each include a part which extends a predetermined distance (width W10) beyond the easy-separating means 2.

After images are formed within these rectangular portions, they are separated from the remaining portion of the printing medium, thereby, forming four printing media without non-print areas.

The extended parts (width W10) extending outside the easy-separating means 2 of the four print areas 5 may be equal to or different from one another. The four print areas 5 may be of different sizes and need not be equal to one another.

Figure 22:
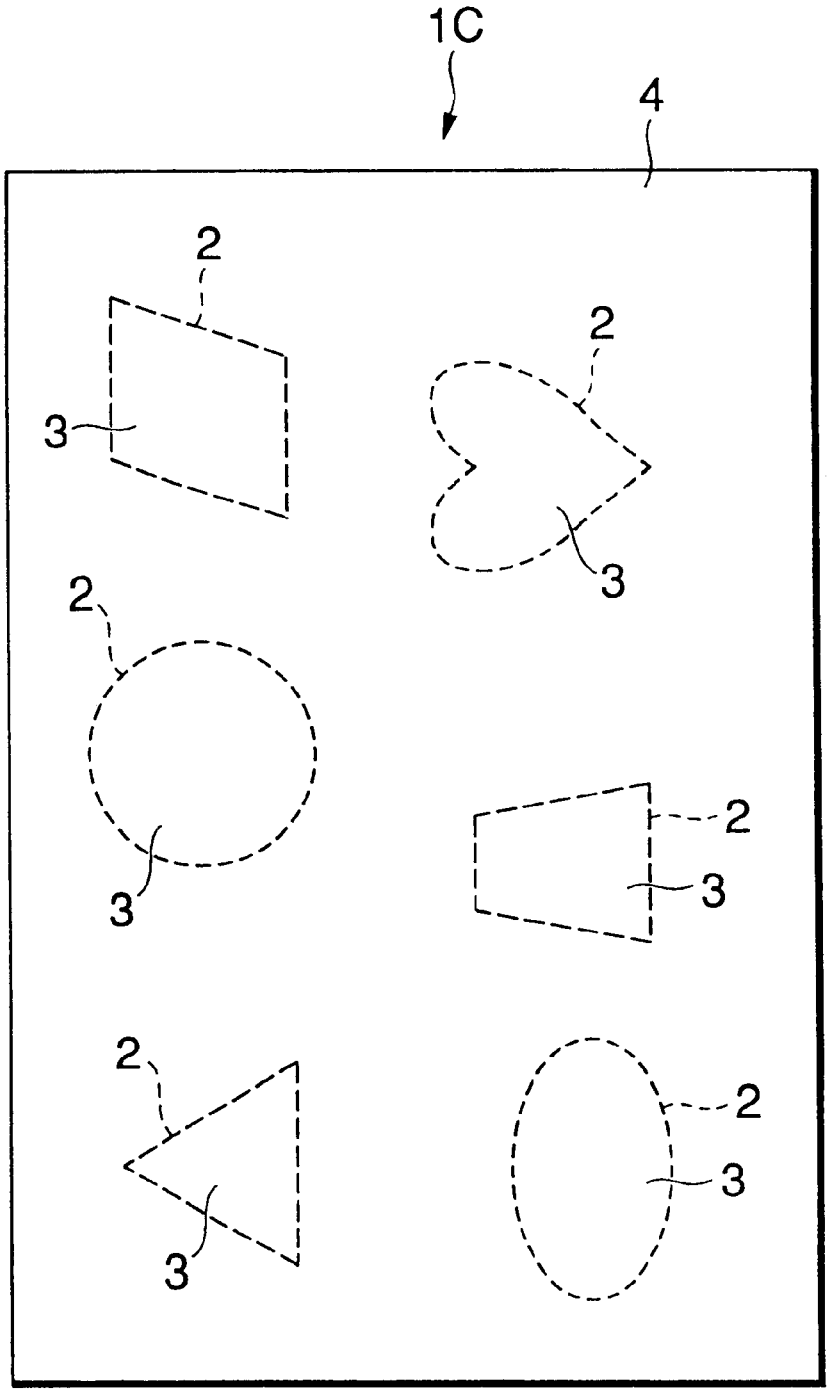
FIG. 22 is a plan view showing yet another printing medium for explaining the FIG. 18 printing method.

In the printing method of the invention, each main portion 3 may take various forms, as in the printing medium 1C shown in FIG. 22, if the print area is slightly larger than the area defined by the easy-separating means.

Another printing method of the invention will now be described. The description of the second printing method will be given using the printing medium 1 shown in FIGS. 1 through 3 and with reference to FIGS. 19 through FIG. 22.

In the printing medium 1 shown in FIG. 1, the easy-separating means 2 is formed in a portion closer to one of the shorter sides 1*b* of the printing medium. The following describes how to print an image on the printing medium 1 shown in FIG. 1.

Figure 19:
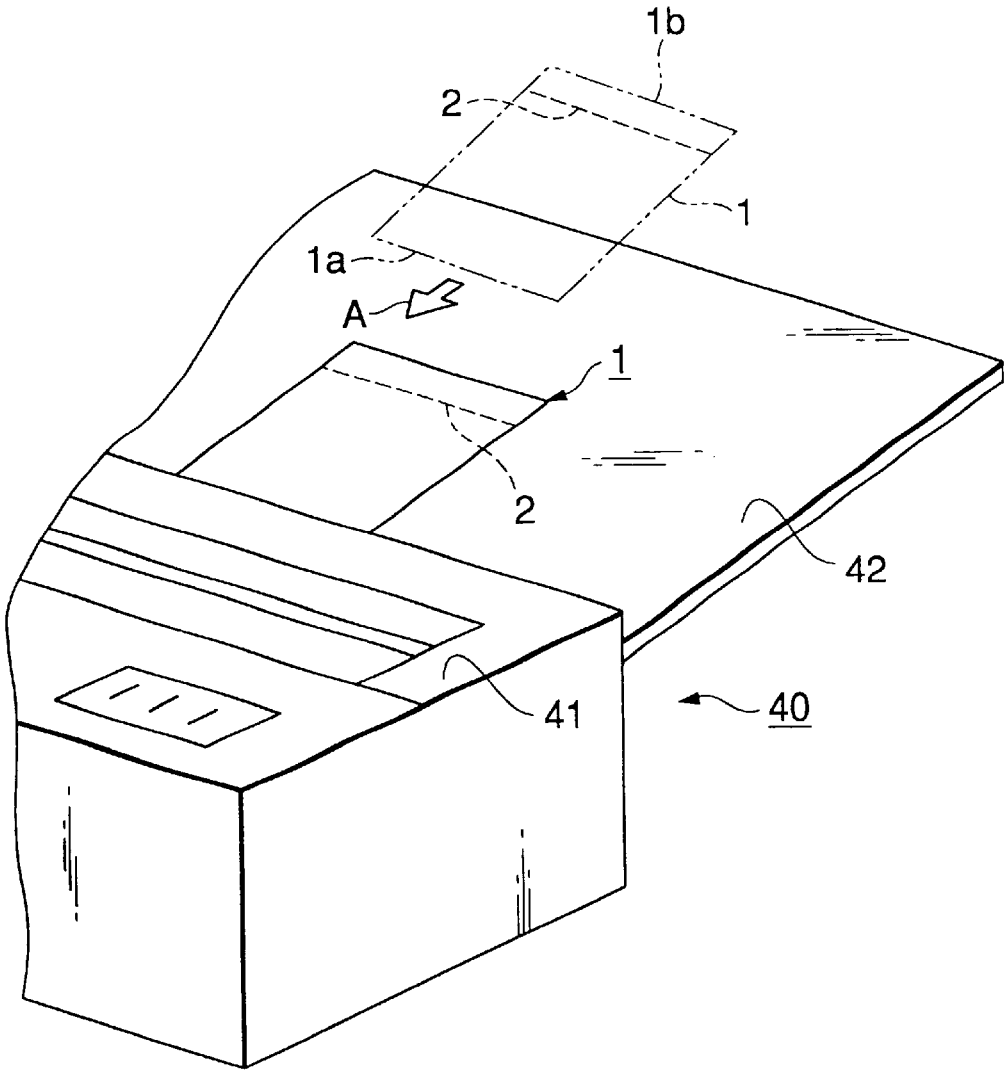
FIG. 19 is a perspective view showing a printing apparatus in which the FIG. 1 printing medium is set, the view being useful in explaining the printing method described in connection with FIG. 18.

As shown in FIG. 19, a printing medium 1 shown in FIG. 1 is put in a paper tray 42 for storing printing media. The paper tray 42 is attached to a main body 41 of the printing apparatus 40 while being extended outwardly from the main body. The printing medium 1 is placed on the tray 42 so that the leading edge is side 1*a* and the trailing edge is side 1*b*

(where the easy-separating means 2 is formed). The terms, "leading" and "trailing" are used when the printing medium is viewed in the advancing direction (indicated by an arrow A) of the printing medium.

The image forming position in the printing apparatus 40 is selected such that a distance W1 (of the non-print area in FIG. 2) measured from the edge of the image in the trailing edge where the easy-separating means 2 is provided to the easy-separating means is equal to the width W2 (distance between the edge of the image and the edge of the printing medium) of the front side.

After the printing medium 1 is thus placed within the printing apparatus 40, the apparatus is operated. The printing medium 1 is transported into the apparatus. On a predetermined location (on the platen), the upper and lower side edges (along the sides 1*c* and 1*d*) of the printing medium, and the rear side edges are properly held along the center line C (FIG. 1), and in this state a given image is formed or printed on the printing medium.

As shown in FIG. 2, the print area 5 is formed at a predetermined location (on the left side of the easy-separating means 2 in FIG. 2) of the main portion 3. At this time, the width W3 of the non-print area 6 (the lower non-print area in the drawing) and the width W4 of the non-print area 6 (the upper non-print area), which are located outside the print area 5, are non-print space margins. The width W0 closer to the cutout portions 4 serves as a non-print space margin, which is larger than the width W2 of the front side (the left side in the drawing) when viewed in the medium advancing direction.

The width W1 of the non-print area 6, which is located in the trailing part of the advancing printing medium 1, may be equal to the width W2 located in the leading part by separating the cutout portions 4 from the main portion, as shown in FIG. 3.

In the present embodiment, the non-print area 6 may be formed so that each width of the non-print area 6 in the horizontal direction is equal and each width of the non-print area 6 in the vertical direction is equal as shown in FIG. 2. It is evident that the form of the non-print area 6 need not be limited in this way.

In the printing medium 1 of FIG. 2, the width W2, width W3, width W4 and width W1 of the non-print area 6 may be substantially equal. (Here, the width W2 is located in the leading part of the advancing medium or the left side in the drawing. The width W3 is located in the lower part in the advancing medium as shown in FIG. 2. The width W4 is located in the upper part in the advancing medium as shown in FIG. 2. The width W1 after the separation along the easy-separating means 2 is located in the trailing portion of the printing medium.) Therefore, it is possible to enhance a considerable merit of the printed printing medium as a printed material. The printing medium thus formed is higher in its quality since the printing medium is formed so that each width of the non-print area in the vertical direction is equal and each width of the non-print area in the horizontal direction is equal.

In the above-mentioned embodiment, the printing medium 1 is discussed in which the single easy-separating means 2 is provided along one of the shorter sides of the printing medium. It should be understood that a printing medium 1D as shown in FIG. 20 also falls within the scope of the present invention.

Figure 20:
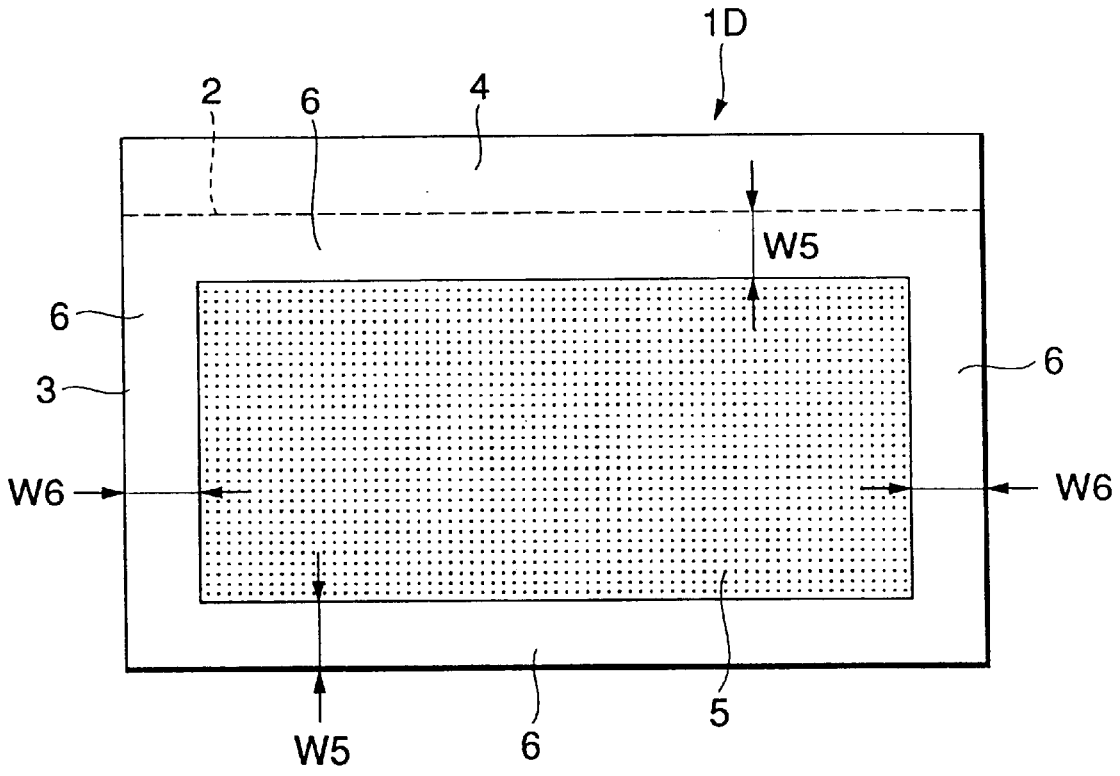
FIG. 20 is a plan view showing a printing medium for explaining the FIG. 18 printing method.

In the printing medium 1D shown in FIG. 20, a single easy-separating means 2 is provided along one of the longer sides of the printing medium. In this embodiment, after an image is formed in the print area 5 without extending over the easy-separating means 2 of the main portion 3, the cutout portion 4 is cut off along the easy-separating means 2, from the print area. As in the above-mentioned embodiment, the result is that the widths W5 and W6 of the non-print areas 6 may be easily reduced, resulting in the print area 5 and the non-print areas 6 being disposed in a well-balanced fashion providing a good visual presentation.

Figure 21:
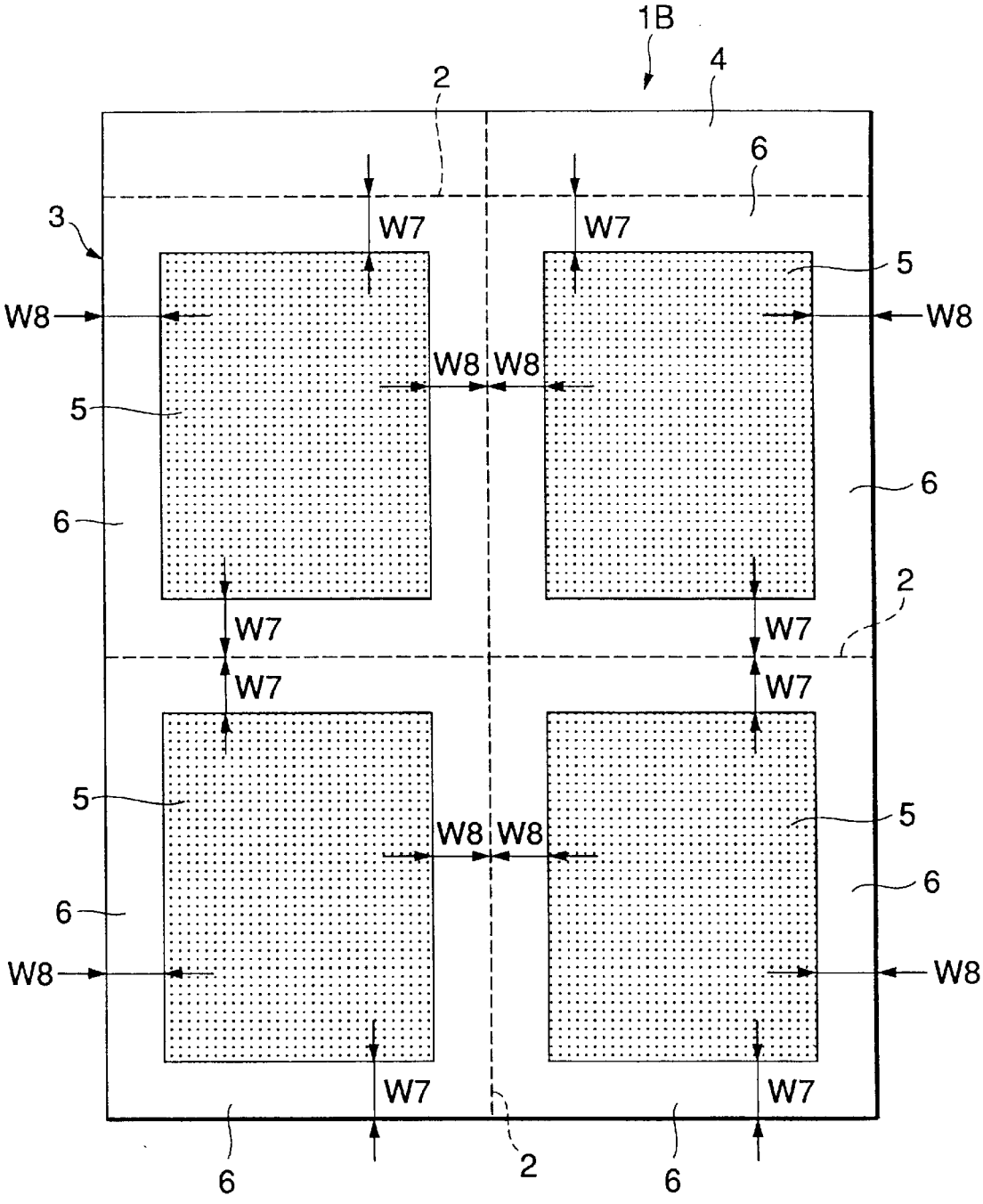
FIG. 21 is a plan view showing another printing medium for explaining the FIG. 18 printing method.

An additional printing medium 1B is illustrated in FIG. 21. As shown, an easy-separating means 2 is formed along a center line along the length of the printing medium. Another easy-separating means 2 is formed closer to and along one of the shorter sides of the printing medium (i.e., along a line parting the printing medium into the main portion 3 and the cutout portion 4). A further easy-separating means 2 is formed so as to quarter the main portion 3 of the printing medium.

In the case of FIG. 21 where a plurality of print areas are formed, each print area may be formed to have the size of a name card.

As shown in the printing medium 1B the main portion 3 is divided into a plurality (four in this case) of segmental print areas on which an image is printed. The four segmental print areas 5 are spaced from the related easy-separating means 2 by predetermined distances W7 and W8 respectively. After the printing of images on the print areas, the cutout portion 4 is cut off from the main portion of the printing medium, and the remaining portion is further separated into four print areas along the easy-separating means 2.

If required, each print area 5 may be equally spaced from its related easy-separating means 2 (i.e., the width W7=width W8). In the embodiment shown in FIG. 21, the four print areas 5 are equal to one another. Those areas may also be different from one another. That is, the print areas, which are formed in the segmental print areas (resulting from the separating of the main portion by the easy-separating means) of the printing medium 1B as shown in FIG. 21 need not always be uniform, provided however, that the space between each print area and its related easy-separating means surrounding the print area is kept at a distance specified according to the invention.

In addition, in the printing method of the invention, the main portion 3 may take various shapes and forms as shown in FIG. 22, provided that the print area is located within the easy-separating means.

A printing medium according to the present invention is provided with easy-separating means enabling one to easily separate the printing medium into at least two segmental portions, whereby the printing medium includes a portion that is easily separable from a main portion thereof. Provision of the easy-separating means facilitates the separation of those segmental areas. Accordingly, the printed printing medium may be shaped in a desired form.

A method for manufacturing printing media according to the present invention includes a process for separating a plurality of printing media 1 from a sheet at one time while leaving one part where each of the printing media is connected to the sheet. Accordingly, the manufacturing method allows for the efficient method manufacturing of a number of printing media each having easy-separating means.

As described above, the present invention allows for a high quality printing medium without having non-print areas around the margins, and without requiring any special means or operations for removing the unnecessary portions along the easy-separating means by employing unique easy-separating means provided inside and entirely along the peripheral edge of the sheet-like printing medium. Accordingly, the peripheral$_{13}$ edge is separable from the printing medium so that when an image is formed on the sheet-like printing medium, a print area is formed extending somewhat beyond the easy-separating means to the peripheral edge of the sheet-like printing medium.

Additionally, in the printing method of the invention, as described above, in forming an image on a printing medium which has easy-separating means and is separable into two segmental portions along the easy-separating means, when the width of the non-print areas left around the peripheral edge of a print area is separated at a part of the easy-separating means, the image is formed while being spaced from the easy-separating means by a predetermined distance so as to be equally spaced from at least the opposite sides of each of the non-print area. Thus, the width of the non-print area may be determined by merely separating the unnecessary portions or areas along the printing medium without any special means and operation. Therefore, the invention provides a high quality printing medium of which a print area and a non-print area are disposed in a well-balanced fashion.

What is claimed is:

1. A printing medium for use in a printer, the improvement which comprises perforations for easily separating said printing medium for use in a printer into at least two separable portions, at least one of said at least two separable portions being a main portion for receiving a printed image, wherein said perforations are one of a continuous cut line having a single continuous cut on said printing medium and a seam-like or dotted cut line having a plurality of cuts on said printing medium, said single continuous cut and said plurality of cuts having a depth equal to or less than the thickness of the printing medium; and wherein said one of said single continuous cut and said plurality of cuts are provided on said printing medium so as to substantially reach an edge of said printing medium without cutting the edge of said printing medium such that an entire peripheral edge of said printing medium is free of cuts, thereby facilitating the separation of said two separable portions at the edge of the printing medium while maintaining the integrity of the peripheral edge of the printing medium; and wherein said printing medium is adapted to be used in the printer, the printer being for print media that are individually fed in the printer; and wherein said printing medium includes an image printed by the printer in said main portion and across the perforations into the other of said at least two separable portions.

2. A printing medium for use in a printer, the improvement which comprises perforations for easily separating said printing medium for use in a printer into separable portions including a central portion defining an entire printing area of said printing medium, and a plurality of separable side portions formed around a circumference of said central portion, wherein said separable side portions are selectively separable from said central portion;

wherein said central portion forms a continuous part of said print medium void of perforations and cuts on both front and back sides of said printing medium;

wherein said printing medium is adapted to be used in the printer, the printer being for print media that are individually fed in the printer; and wherein said printing medium includes an image printed by the printer in said central portion and across the perforations into at least one of said side portions.

3. A printing medium for use in a printer, the improvement which comprises perforations for easily separating said printing medium for use in a printer into at least two separable portions, at least one of said at least two separable portions being a main portion for receiving a printed image, wherein said perforations are one of a continuous cut line having a single continuous cut on said printing medium and a seam-like or dotted cut line having a plurality of cuts on said printing medium, said single continuous cut and said plurality of cuts having a depth equal to or less than the thickness of the printing medium; and wherein said one of said single continuous cut and said plurality of cuts are provided on said printing medium so as to substantially reach an edge of said printing medium without cutting the edge of said printing medium such that an entire peripheral edge of said printing medium is free of cuts, thereby facilitating the separation of said two separable portions at the edge of the printing medium while maintaining the integrity of the peripheral edge of the printing medium; and wherein said printing medium is adapted to be used in the printer, the printer being for print media that are individually fed in the printer; and wherein said printing medium includes an image printed by the printer in said main portion so that an edge of said main portion, upon removal of the other of said at least two separable portions from said main portion, has a part of the image printed thereat.

4. A printing medium for use in a printer, the improvement which comprises perforations for easily separating said printing medium for use in a printer into separable portions including a central portion defining an entire printing area of said printing medium, and a plurality of separable side portions formed around a circumference of said central portion, wherein said separable side portions are selectively separable from said central portion;

wherein said central portion forms a continuous part of said print medium void of perforations and cuts on both front and back sides of said printing medium;

wherein said printing medium is adapted to be used in the printer, the printer being for print media that are individually fed in the printer; and wherein said printing medium includes an image printed by the printer in said central portion so that an edge of said central portion, upon removal said side portions, has a part of the image printed thereat.

* * * * *

UNITED STATES PATENT AND TRADEMARK OFFICE

CERTIFICATE OF CORRECTION

PATENT NO. : 6,652,171 B1
DATED : November 25, 2003
INVENTOR(S) : Hiroyuki Onishi It is certified that error appears in the above-identified patent and that said Letters Patent is hereby corrected as shown below:

Title page,
Please add the following:
-- [73] Assignee: Seiko Epson Corporation, Tokyo, Japan --

Signed and Sealed this

Twenty-fifth Day of May, 2004

JON W. DUDAS
*Acting Director of the United States Patent and Trademark Office*